US005367885A

United States Patent [19]

Sagar

[11] Patent Number: 5,367,885

[45] Date of Patent: Nov. 29, 1994

[54] CHILLER PRESSURIZATION SYSTEM

[76] Inventor: Christopher L. Sagar, 9236 93rd St. North, Largo, Fla. 34647

[21] Appl. No.: 182,880

[22] Filed: Jan. 18, 1994

[51] Int. Cl.[5] ..... F25B 49/00

[52] U.S. Cl. ..... 62/125; 62/435; 62/201

[58] Field of Search ..... 62/99, 201, 435, 125

[56] References Cited

U.S. PATENT DOCUMENTS 4,584,845 4/1986 Hansen et al. ..... 62/201

4,856,578 8/1989 McCahill ..... 62/201

*Primary Examiner*—John M. Sollecito

*Attorney, Agent, or Firm*—Joseph C. Mason, Jr.; Ronald E. Smith

[57] ABSTRACT

A chiller is quickly pressurized by heating water in the evaporation circuit of the chiller water loop by pumping the water into a first heat exchanger where it is heated by hot refrigerant fluid from a compressor. A non-cavitating jet pump circulates the water through the first heat exchanger. A second heat exchanger in fluid communication with the first returns the refrigerant fluid to its vapor state before it returns to the compressor by absorbing heat from tap water. Plural monitoring devices in electrical communication with a control device are arranged throughout the system and the control device deactivates the compressor and the jet pump if monitored operating conditions fall outside of predetermined ranges.

12 Claims, 1 Drawing Sheet

CHILLER PRESSURIZATION SYSTEM

BACKGROUND OF THE INVENTION

1. Field of the Invention

This invention relates, generally, to improvements in air conditioning systems. More particularly, it relates to an apparatus for quickly pressurizing a chiller for maintenance purposes.

2. Description of the Prior Art

Air conditioning systems are a well known source of compounds that cause depletion of the ozone layer; thus, system operators can be fined for operating systems that leak harmful compounds into the atmosphere. Leaks are usually found by taking the chiller out of service and pressurizing it; leak detection when the system is operating is impractical because the chiller evaporator operates at less than atmospheric pressure. There is insufficient time to check for leaks during summer daylight hours when maintenance crews are available because the leak-testing procedure is very time-consuming and most systems cannot remain inoperative for the required amount of time.

Routine preventative maintenance is therefore performed on air conditioning system chillers usually about once a year, typically during the winter months when the demand for air conditioning is low. The maintenance procedures include pressurization of the chiller so that it may be tested for leaks as aforesaid and so that oil in the sump may be removed and replaced.

Chillers are pressurized by heating water in the evaporization circuit of the chiller; this raises the temperature of the refrigerant and thus enables the system to be checked for refrigerant leaks and enables oil removal as aforesaid. Current practice employs conventional hot water heaters and pumps to heat the water and to circulate it. The process requires several hours for small chillers, and can take all day where a large chiller is involved. The maintenance crew must wait for the pressurization to be completed before the leak testing and oil changing procedures can be started. Thus, the cost of the procedure is quite high.

What is needed, then, is an apparatus that quickly pressurizes a chiller. Such a system would free the maintenance crew for other tasks and would be less expensive for the system operator. However, the conventional technique is the only obvious way to perform the task because those of ordinary skill in the art have been performing the conventional technique for decades and have been unable to improve upon it even though the need for improvement is apparent to everyone in the art.

SUMMARY OF THE INVENTION

The present invention revolutionizes the art by providing a system that pressurizes even the largest chillers in less than an hour. Chillers of average size are pressurized in a mere fifteen minutes or so. Thus, the invention represents a pioneering breakthrough in the art.

The system eschews the teachings and suggestions of the art and does not employ the hot water heaters and circulation pumps of the prior art. Instead, it takes the art in a new direction by providing a refrigeration cycle employing an R-22 refrigerant or suitable equivalent. Cold water from the evaporator circuit of the chiller water loop is extracted from the chiller and introduced into a high pressure, high speed jet pump through a pressure switch under the control of a control means.

The pump sends the water into a first tube-in-tube heat exchanger where the water is heated by said R-22 refrigerant. The heated water is then routed back to the chiller; due to the very rapid heating of the water made possible by this novel arrangement, the chiller can be pressurized very rapidly.

The heat exchanger condenses the R-22 refrigerant; to return it to vapor form before it re-enters the compressor, a second tube-in-tube heat exchanger is employed. One tube carries the condensed refrigerant, and the other tube carries ordinary unheated tap water. The refrigerant extracts heat from the tap water and returns to vapor form; it enters an accumulator and then returns to the compressor for repressurization and reheating prior to re-entry into the first heat exchanger. The cooled water is discharged to an external drain.

Thus it is clear that the primary object of this pioneering invention is to substantially reduce the amount of time required for pressurization of chillers.

A more specific object is to provide the world's first chiller pressurization system that transfers heat from a refrigerant in a refrigeration cycle to water from the evaporator circuit of a chiller.

These and other important objects, features and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawing, in which:

The FIG. is a diagrammatic depiction of an illustrative embodiment of the inventive system.

DETAILED DESCRIPTION OF THE PREFERRED EMBODIMENT

Figure 1:
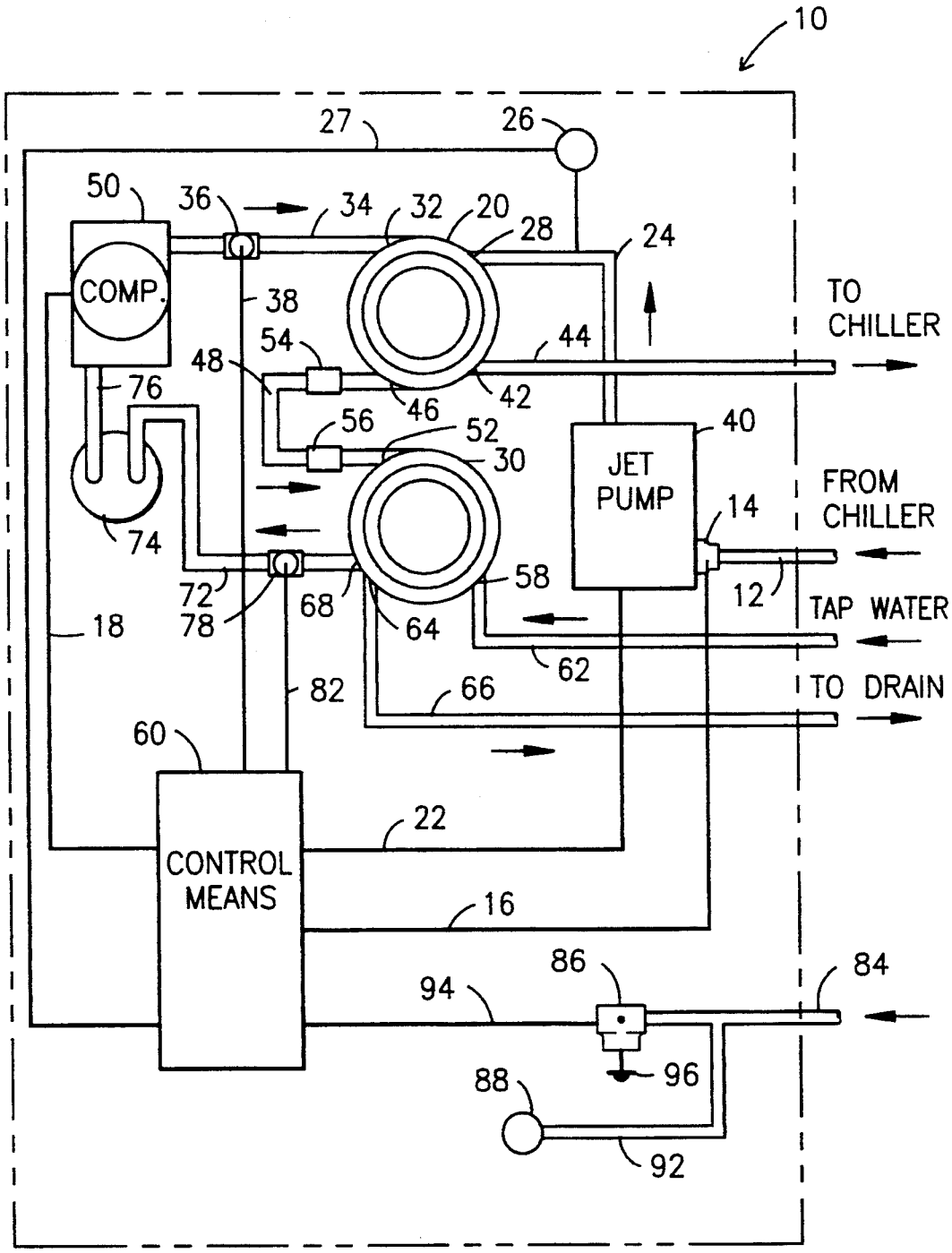

Referring now to the Figure, it will there be seen that an exemplary embodiment of the invention is denoted as a whole by the reference numeral 10.

The first and second heat exchangers are denoted 20 and 30, respectively, the jet pump and the compressor are denoted 40 and 50, respectively, and the control means is denoted 60.

More specifically, chiller pressurization system 10 includes a special non-collapsible hose 12 that delivers cold water from the evaporator circuit of a chiller water loop, not shown, to first heat exchanger 20 through pressure switch 14 and jet pump 40. The function of pressure switch 14, hereinafter referred to as the first pressure switch, is to detect the presence of water; when the presence of water is detected, a time circuit that controls operation of jet pump 40 and compressor 50 is started. More particularly, line 16 interconnects first pressure switch 14 and control means 60, and line 18 interconnects said control means 60 and compressor 50. Line 22 interconnects control means 60 and jet pump 40. In this manner, jet pump 40 and compressor 50 operate only when water is extracted from said evaporator circuit of the chiller water loop.

Jet pump 40 is a high speed, high pressure pump capable of pumping high volumes of water in the substantial absence of cavitation. More particularly, the pump is rated at thirty five to sixty pounds per square inch, thirty five to sixty five gallons per minute. Accordingly, water is discharged from pump 40 at 35–60 psi and at a rate of 35–60 gpm into conduit 24. First temperature gauge 26 monitors the temperature of the water flowing through conduit 24. Line 27 interconnects temperature gauge 26 and control means 60; when the temperature of the water in conduit 24 exceeds a predetermined temperature, control means 60 deactivates the system. Temperature gauge 26 is also visually monitored. The water in conduit 24 then enters first heat exchanger 20 at first inlet 28. Heat exchanger 20 is of the tube-in-tube type; one of the tubes carries the water from conduit 24, and the other tube carries refrigerant fluid, preferably rated R-22. The refrigerant fluid is delivered to the second inlet 32 of heat exchanger 20 by conduit 34 which is in fluid communication with the high pressure side of compressor 50. Thus, the refrigerant fluid entering first heat exchanger 20 at second inlet 32 is at a high temperature and has the capacity to rapidly heat the cold chiller water.

More specifically, compressor 50 discharges hot compressed gas at a temperature and pressure range that extends from about one hundred ten degrees Fahrenheit and two hundred twenty five psi to about one hundred fifty degrees and three hundred seventy five psi. Second pressure switch 36 at the discharge outlet of compressor 50 is connected to control means 60 by line 38 and ensures that the pressures of the hot gas stay within said range. Unacceptably high pressures at second pressure switch 36 result in system shutdown by control means 60.

The heated water exits first heat exchanger 20 at first outlet 42 and is returned to the evaporator circuit of the chiller water loop by return conduit 44 which includes a special non-collapsible hose.

Significantly, as should be appreciated from the disclosure of jet pump 40, the water flows through first heat exchanger as does the hot refrigerant fluid, at a very high rate of speed. The refrigerant fluid flows in a first direction away from compressor 50 and the water flows in an opposite direction. Thus, the dwell time for the heat exchange is of short duration, but it has been found that the very high temperature of the hot refrigerant raises the temperature of the cold water very rapidly. Thus, heated water returning to the evaporator circuit of a chiller water loop through conduit 44 will pressurize even the largest chiller in less than an hour; the earlier techniques require about eight hours to achieve the needed pressurization.

The heat exchange process that occurs in heat exchanger 20 condenses the refrigerant. To return it to its vapor state so that it may be returned to the suction side of compressor 50, the condensed refrigerant exits first heat exchanger 20 at second outlet 46 and is delivered by conduit 48 to the second inlet 52 of second heat exchanger 30 for heating. The refrigerant fluid is first dried by dryer means 54. After drying, the fluid flows through expansion valve 56 which meters the refrigerant into said second heat exchanger. Unheated tap water enters second heat exchanger 30 at first inlet 58 thereof from the opposite direction through conduit 62; after the heat exchange, the cooled tap water exits first outlet 64 of heat exchanger 30 and is drained through conduit 66. The heat exchange extracts heat from the water and warms the refrigerant and returns it to its vapor state; the vapor exits second heat exchanger 30 at second outlet 68 and flows through conduit 72 to suction accumulator 74 and from said accumulator to compressor 50 through conduit 76. Suction accumulator 74 protects compressor 50 from slugging. Note also third pressure switch 78 in conduit 72; it is electrically connected to control means 60 through line 82 and shuts down the system if the pressure therein drops below a predetermined threshold.

Overpressurization may occur if the chiller gas is too hot. Accordingly, conduit 84 at the lower right hand corner of the Figure delivers a small quantity of the chiller gas to an adjustable pressure switch 86 and a second temperature gauge 88 is in fluid communication with conduit 84 through conduit 92. In this way, if the pressure or temperature of the chiller gas exceeds a predetermined threshold, a signal is sent from pressure switch 86 or second temperature gauge 88 to control means 60 over line 94 and said control means shuts down the system. Pressure switch 86 thus provides both a safety feature and an autocycle feature; the autocycle feature allows the unit to maintain proper temperatures and pressures.

Adjustment knob 96 of pressure switch 86 enables the system operator to set the pressure to which the interior of the chiller will be raised; in a preferred embodiment, the operator may set the pressure at any point between thirty inches of vacuum and ten pounds per square inch by rotating adjustment knob 96.

Where the prior art techniques require four to eight hours to raise a five inch vacuum to eight psi, depending upon the size of the chiller, the present apparatus accomplishes the same feat in less than an hour even for the largest of chillers.

This invention is clearly new and useful. Moreover, it was not obvious to those of ordinary skill in this art at the time it was made, in view of the prior art considered as a whole as required by law.

This invention pioneers the art of high speed chiller pressurization. Accordingly, the claims that follow are entitled to broad interpretation, as a matter of law, to protect from piracy the heart or essence of this breakthrough invention.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A system for pressurizing a chiller, comprising:

a refrigeration circuit including a compressor;

a first heat exchanger having a first inlet disposed in fluid communication with an evaporator circuit of a water loop of said chiller;

said first heat exchanger having a second inlet disposed in fluid communication with a discharge side of said compressor so that hot refrigerant enters said first heat exchanger; and said first heat exchanger having a first outlet providing means for returning heated water from said first heat exchanger to said evaporator circuit;

whereby said first heat exchanger defines means for heating cold water from said evaporator circuit to quickly pressurize said chiller.

2. The system of claim 1, further comprising:

a second heat exchanger having a first inlet in fluid communication with a source of tap water;

said second heat exchanger having a second inlet in fluid communication with a second outlet of said first heat exchanger for receiving refrigerant fluid therefrom;

said second heat exchanger having a first outlet in fluid communication with a drain;

said second heat exchanger having a second outlet in fluid communication with said compressor;

whereby heat is exchanged from said tap water to said refrigerant fluid to convert said refrigerant fluid into vapor prior to return of said refrigerant fluid to said compressor.

3. The system of claim 2, further comprising a jet pump disposed in fluid communication between said evaporator circuit and said first inlet of said first heat exchanger so that water is delivered at a high rate to said first heat exchanger.

4. The system of claim 3, further comprising:

a plurality of monitoring devices disposed at predetermined locations throughout said system for monitoring preselected conditions;

a control means;

said control means being disposed in electrical communication with each of said plurality of monitoring devices;

said control means being disposed in electrical communication with said jet pump and said compressor;

whereby said control means deactivates said jet pump and compressor if conditions monitored by said plurality of monitoring devices are outside of predetermined limits.

5. The system of claim 4, further comprising a first pressure switch disposed between said evaporator circuit and an inlet of said jet pump, said first pressure switch monitoring the presence or absence of water at said inlet of said jet pump, whereby said control means deactivates said jet pump and compressor if said first pressure switch detects an absence of water at said inlet of said jet pump.

6. The system of claim 4, further comprising a suction accumulator disposed in fluid communication between said second outlet of said second heat exchanger and said compressor.

7. The system of claim 4, further comprising a second pressure switch disposed between said discharge side of said compressor and said second inlet of said first heat exchanger, said second pressure switch being in electrical communication with said control means, whereby said control means deactivates said compressor and jet pump when said second pressure switch detects a condition outside of predetermined limits.

8. The system of claim 6, further comprising a third pressure switch disposed between said second outlet of said second heat exchanger and said suction accumulator.

9. The system of claim 4, further comprising a first temperature gauge disposed between said jet pump and said first inlet of said first heat exchanger, said first temperature gauge being disposed in electrical communication with said control means and said control means being operative to deactivate said jet pump and said compressor if the temperature detected by said first temperature gauge falls outside a predetermined range.

10. The system of claim 4, further comprising:

a conduit means for carrying hot gases from the chiller into said system;

an adjustable pressure switch disposed in said conduit means;

a second temperature gauge disposed in temperature-measuring relation to said hot gases in said conduit means;

said adjustable pressure switch being in electrical communication with said control means;

whereby said control means deactivates said compressor and said jet pump if said adjustable pressure switch detects a pressure outside of predetermined limits; and whereby said control means deactivates said compressor and jet pump if said second temperature gauge detects a temperature outside of predetermined limits.

11. The system of claim 10, wherein said adjustable pressure switch includes means for manually setting said adjustable pressure switch to a range of pressures between about thirty inches of vacuum and about eight pounds per square inch, said control means being operative to deactivate the system when the chiller has been pressurized to a pressure indicated by said adjustable pressure switch.

12. The system of claim 4, further comprising a dryer and an expansion valve disposed in fluid communication with one another between said second outlet of said first heat exchanger and said second inlet of said second heat exchanger.

* * * * *